US008136850B2

(12) United States Patent
Wollacott et al.

(10) Patent No.: US 8,136,850 B2
(45) Date of Patent: Mar. 20, 2012

(54) PADDLE LATCH

(75) Inventors: Martin Wollacott, Redditch (GB); Matthew Downing, Stourbridge (GB)

(73) Assignee: Western Body Hardware Limited (GB)

( * ) Notice: Subject to any disclaimer, the term of this patent is extended or adjusted under 35 U.S.C. 154(b) by 924 days.

(21) Appl. No.: 11/693,428

(22) Filed: Mar. 29, 2007

(65) Prior Publication Data

US 2007/0252393 A1 Nov. 1, 2007

(30) Foreign Application Priority Data

Apr. 1, 2006 (GB) ..... 0606631.0

(51) Int. Cl.
*E05C 1/12* (2006.01)

(52) U.S. Cl. ..... 292/173; 70/208

(58) Field of Classification Search ..... 292/173, 292/336.3, DIG. 31, DIG. 27, DIG. 30, DIG. 62; 70/208

See application file for complete search history.

(56) References Cited

U.S. PATENT DOCUMENTS

| | | | | |
|---|---|---|---|---|
| 4,320,642 | A | 3/1982 | Pastva, Jr. | |
| 4,335,595 | A | 6/1982 | Swan et al. | |
| 5,046,340 | A * | 9/1991 | Weinerman et al. | 70/208 |
| 5,439,260 | A * | 8/1995 | Weinerman et al. | 292/48 |
| 6,543,821 | B1 * | 4/2003 | Weinerman et al. | 292/123 |
| 6,708,537 | B1 * | 3/2004 | Eschweiler et al. | 70/208 |
| 6,854,304 | B2 * | 2/2005 | Linares | 70/208 |
| 2005/0110283 | A1 | 5/2005 | Witiak et al. | |

FOREIGN PATENT DOCUMENTS

| | | |
|---|---|---|
| GB | 1304642 | 4/1971 |

OTHER PUBLICATIONS

European Search Report for United Kingdom Application No. GB0606631.0, dated Jul. 5, 2006, 1 pg.

* cited by examiner

*Primary Examiner* — Kristina Fulton
(74) *Attorney, Agent, or Firm* — Barnes & Thornburg LLP

(57) ABSTRACT

A paddle latch comprising a housing defining a first side and a second side, a shaft extending through the housing defining a first shaft portion on the first side and a second shaft portion on the second side, a paddle for actuation by a latch user on the first side and a releasable latch member for co-operation with an associated striker to latch the paddle latch on the second side wherein the paddle is connected to the first shaft portion and the latch member is connected to the second shaft portion such that torque may be transferred from the paddle to the latch member to release the latch member from the striker in use.

13 Claims, 10 Drawing Sheets

PADDLE LATCH

REFERENCE TO RELATED APPLICATIONS

This application claims priority to United Kingdom Patent Application 0606631.0 filed on Apr. 1, 2006, the entirety of which is incorporated by reference herein.

BACKGROUND TO THE INVENTION

The present invention relates to a paddle latch for a closure. Particularly, although not exclusively, the present invention concerns paddle latches designed to be installed on the doors of heavy plant containers and buildings where water ingress to the interior of the container or building is undesirable.

It is known to provide paddle latches on the doors of heavy plant containers or buildings containing heavy plant equipment such as generators or pumps. Paddle latches are suited to this application as paddles generally provide a large area with which to actuate the latch, which can be advantageous if the user is wearing protective gloves. Furthermore, the paddle latch acts as a latch and handle whereby the user only needs to pull on the paddle to both actuate the latch and open the door in the same movement.

Paddle latches often comprise a latch member which, when in a latched condition, engages with a feature on the door frame such that the door cannot be opened. The latch member is often mounted on a shaft such that it can rotate from a latched position whereby it engages the feature on the door frame to an unlatched position whereby it is clear of that feature and the door can be opened.

In known paddle latches, the latch member is often resiliently biased towards the latched position. Unlatching can be achieved by actuating the paddle which physically contacts the latch member overcoming the resilient bias and moving the latch member into an unlatched position whereby the door may be opened. It is also known for the interaction between the paddle and the latch member to only act to move the latch member into an unlatched position. Therefore when the paddle is in the closed position, movement of the latch member will not cause corresponding movement of the paddle. Consequently, the door can be closed and latched without any corresponding motion of the paddle. This is desirable as it is instinctive to apply a door closing force upon the paddle, and if it was to move in an opposite sense to the applied force, this movement would create both undue stresses on the components of the latch and would make closing the door more difficult.

In order to provide a slam function that allows the door to be shut without corresponding movement of the paddle, previous paddle latches have provided a mechanical interaction between the paddle and the latch member that is only effective in a single direction, such that movement of the paddle actuates the latch member from a latched to an unlatched position (in order to open the door), but movement of the latch member from a latched position to an unlatched position and back again (e.g. during door closure) does not cause corresponding motion of the paddle.

It is generally undesirable to allow water ingress into the container or building in which the equipment is stored. Heavy plant equipment such as generators and transformers do not respond well to the presence of water, and regulations stipulating levels of sealing on the containers or buildings are becoming ever more stringent. Water ingress can not only impair the operation of this equipment, but can also cause corrosion of metals. Furthermore, water can collect in sumps provided under such equipment, reducing their capacity for collecting oil, and resulting in oil over-flowing into the surrounding environment.

Items of heavy plant equipment such as generators often create a negative pressure environment inside the container or building as they operate, which results in a "suction" effect at any orifices between the exterior and the interior of a container or building. This suction effect draws in any water that may be present on the surface of the container or building resulting from rain fall or condensation.

Furthermore, items of heavy plant equipment (such as generators) often create a lot of noise. Any such noise can be transmitted from the interior to the exterior of the container via orifices and slots in latches. This noise can be disruptive, and cause discomfort to those in the vicinity of the container. It is therefore desirable to decrease the noise transmitted from the interior to the exterior of the container.

As discussed above, known paddle latches require that the paddle (normally located on the exterior of the building for access) and the latch member (normally located on the interior of the building such that it can contact a part of the door frame) have to be in contact in order for the latch to operate. The requirement for a mechanical interaction implies that there must be some kind of orifice or slot through which one of the components must pass in order to interact with the other. Furthermore, due to the motion of the components the orifice or slot is usually at least partially open in order to allow linear movement during operation.

Bearing in mind the requirement for sealing discussed above, the existence of such slots and orifices is disadvantageous in paddle latches.

SUMMARY OF THE INVENTION

It is an object of this invention to provide an improved paddle latch.

According to a first aspect of the invention there is provided a paddle latch comprising a housing defining a first side and a second side, a shaft extending through the housing defining a first shaft portion on the first side and a second shaft portion on the second side, a paddle for actuation by a latch user on the first side and a releasable latch member for co-operation with an associated striker to latch the, latch paddle on the second side wherein the paddle is connected to the first shaft portion and the latch member is connected to the second shaft portion such that torque may be transferred from the paddle to the latch member to release the latch member from the striker in use.

As discussed, known latches often comprise shafts on which the paddle rotates, but the interaction between the paddle and the latch member is normally a direct one giving rise to the necessity for large slots or orifices, which can cause water ingress into the container or building. The present invention overcomes this by allowing the drive shaft to transfer the force between the paddle and the latch member such that the only orifices that are required in the paddle latch are those through which the drive shaft must pass. This is advantageous as the drive shaft motion is only rotational and therefore orifices with a tight fit can be used, which may be more resistant to water ingress than prior art latches whilst still providing the required functionality.

Large slots of orifices can transmit noise from the interior to the exterior of the container, which is undesirable (as discussed above). The present invention mitigates this problem by allowing the drive shaft to transfer the force between the paddle and the latch member such that the only orifices that are required in the paddle latch are those through which the drive shaft must pass. Consequently as the drive shaft fits tightly inside these orifices, there is very little or no gap through which noise may pass.

A latch retention device will now be described in detail by way of example and with reference to the accompanying drawings in which:

DETAILED DESCRIPTION OF THE PREFERRED EMBODIMENT

Figure 1:
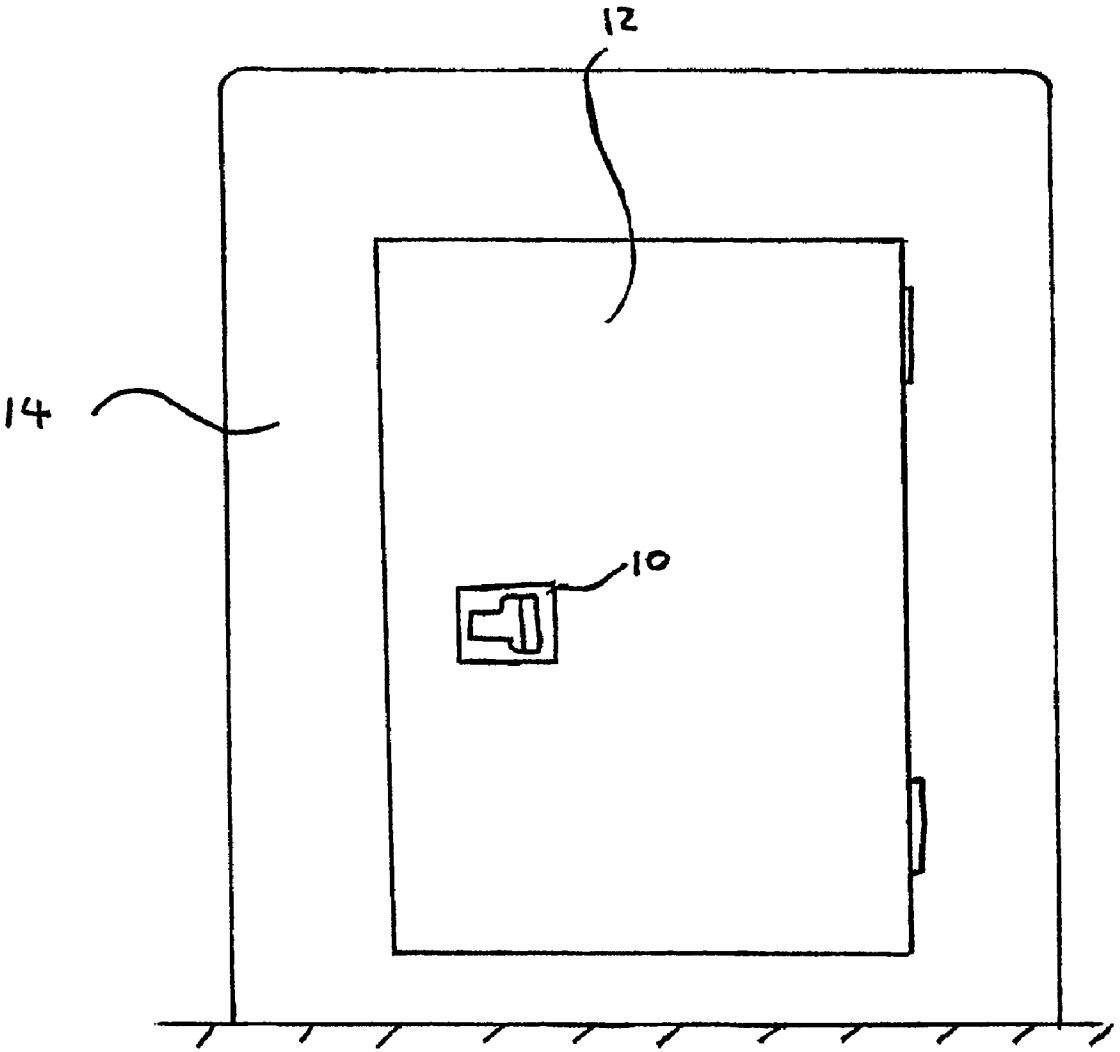
FIG. 1 is a front elevation of a wall of a container comprising a door and a paddle latch in accordance with the present invention.

Referring to FIG. 1 a paddle latch 10 is configured for use with a door 12 on a container 14.

Figures 3, 3A:
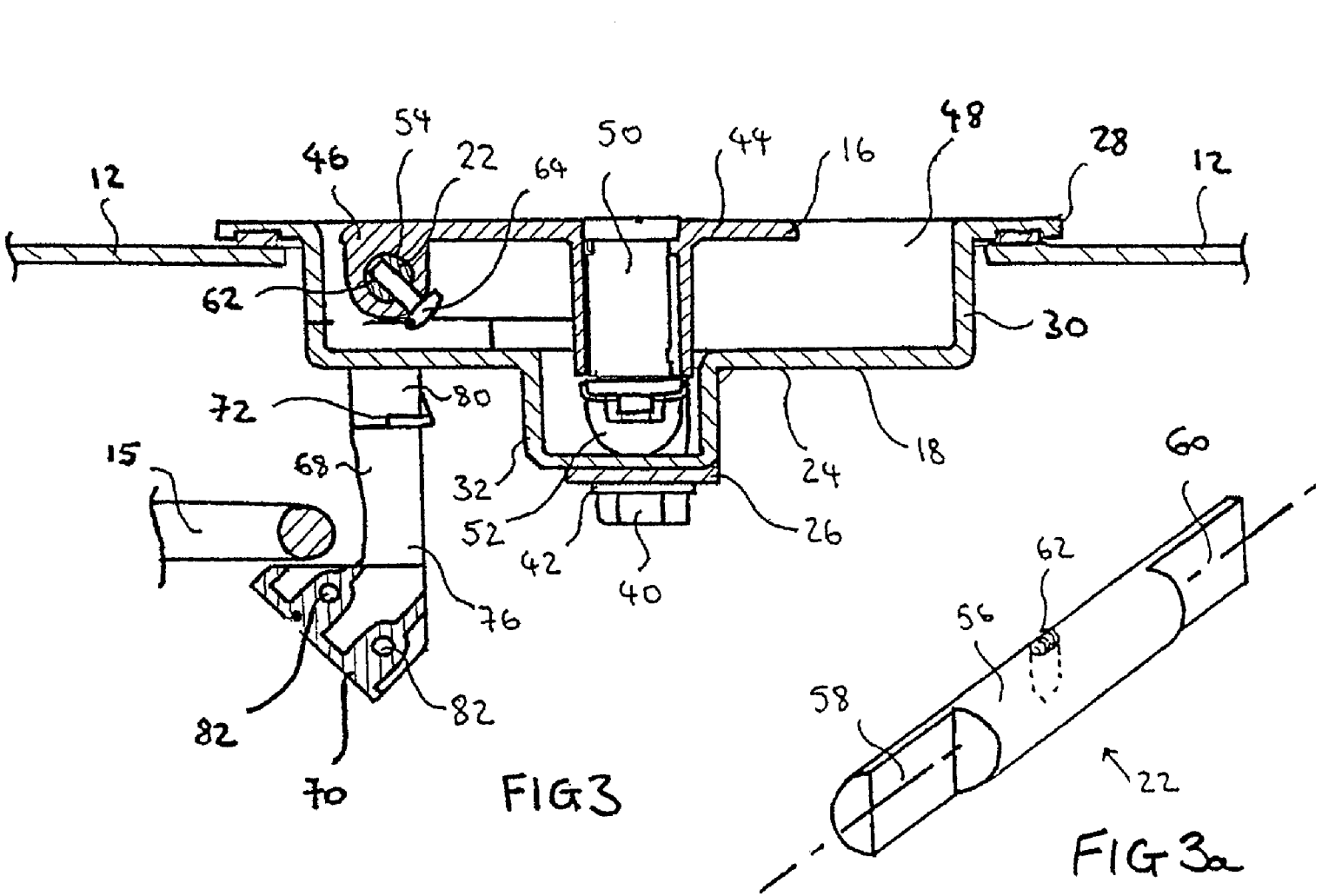
FIG. 3 is a side section view of the latch of FIG. 2 in the direction denoted by III.
FIG. 3*a* is a perspective view of a drive shaft for the latch of FIG. 2.

The container 14 comprises a striker 15 (as shown in FIG. 3) with which the panel latch 10 interacts in order to secure the door 12 in a closed position. The striker 15 may take many forms but is generally a metal member or bar attached to the container 14, or simply a portion of the door surround of the container.

Referring to FIGS. 2 to 6, paddle latch 10 comprises a handle, commonly referred to as a paddle 16, housing 18, latch member 20 and drive shaft 22.

Figures 4, 4A:
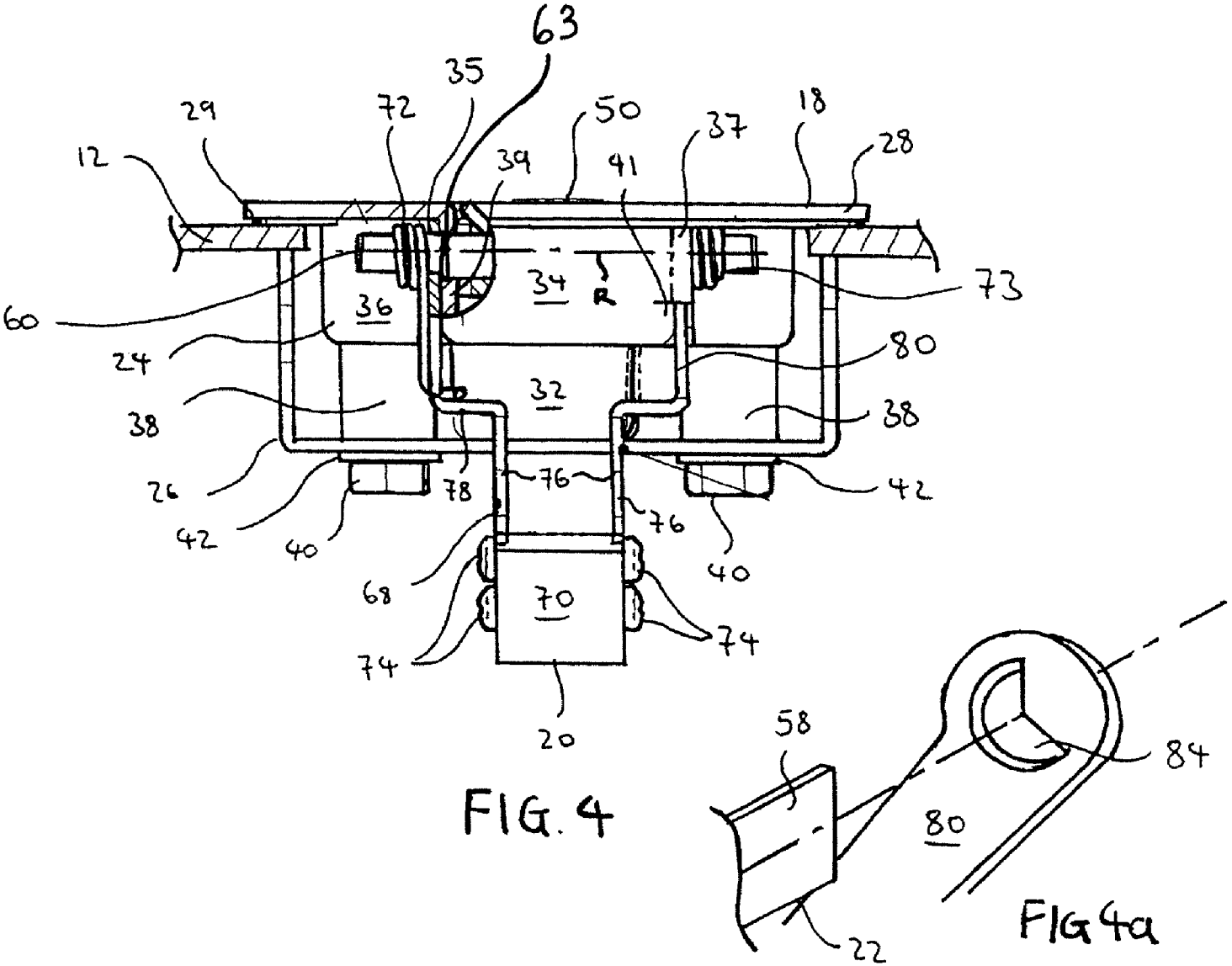
FIG. 4 is an end view of the latch with FIG. 2 with a partially cut-away section.
FIG. 4*a* is a perspective exploded view of a drive shaft and latch arm for the latch of FIG. 2.
Figure 5:
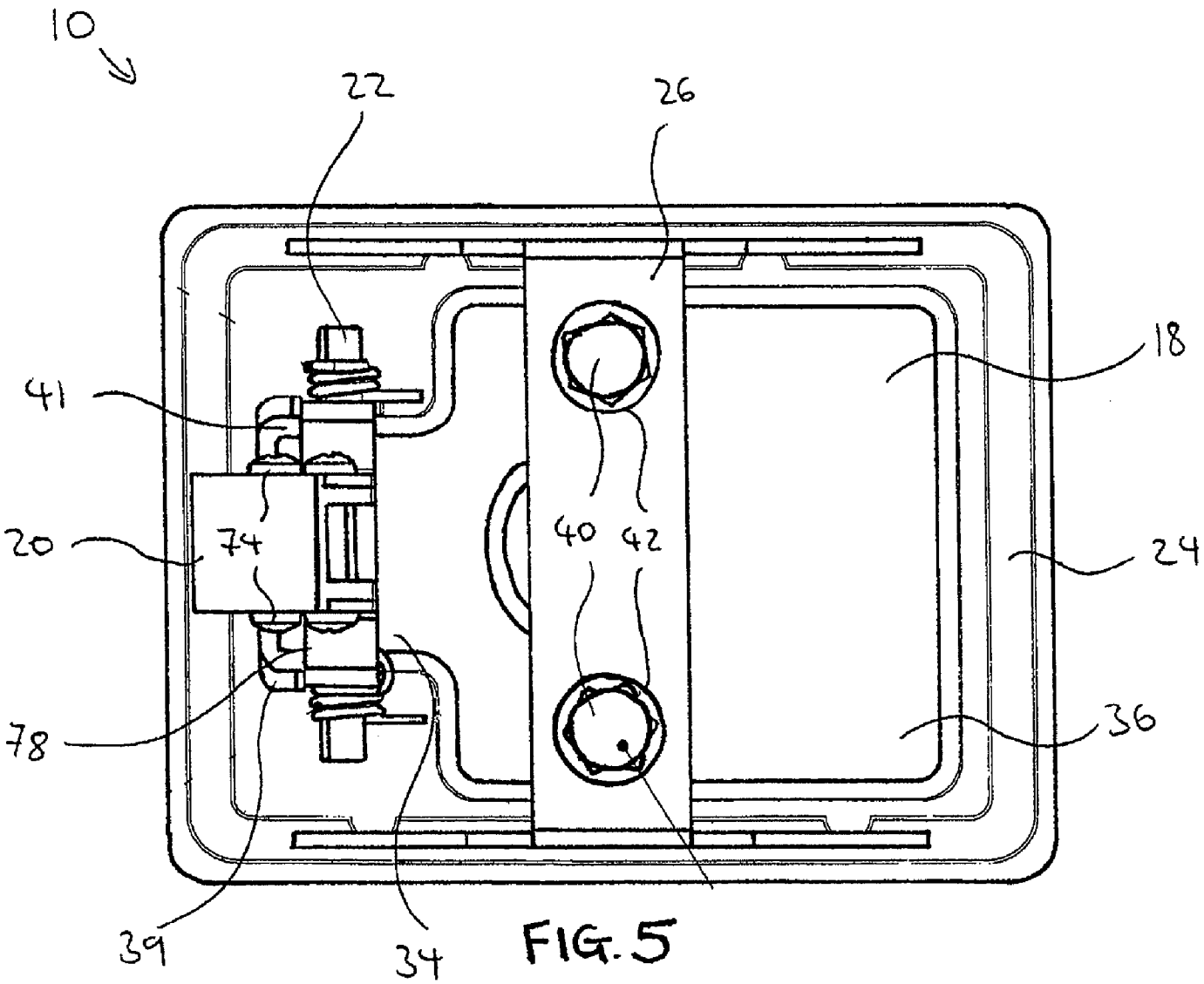
FIG. 5 is a bottom view of the latch of FIG. 2.
Figure 6:
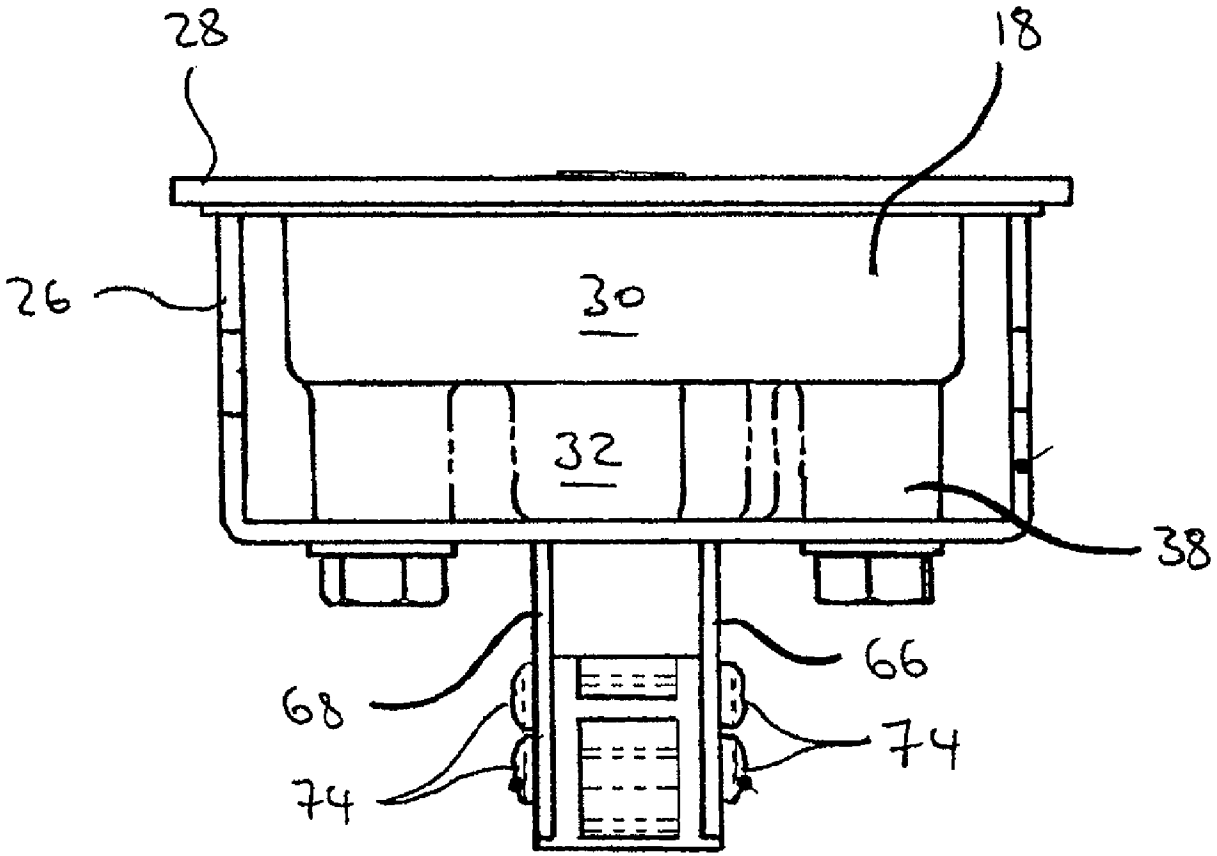
FIG. 6 is an end view of the latch of FIG. 2.

The housing 18 comprises a housing body 24 and an attachment bracket 26 as depicted in FIG. 4.

The housing body 24 is a moulded plastic or stamped metal component comprising a substantially flat flanged portion 28, a first depression 30 and a further depression 32 formed therein. The first depression 30 comprises a small rectangular section 34 and an adjacent large rectangular section 36. The small rectangular section 34 comprises a circular orifice 35 defined through two opposite side walls 39, 41 thereof. The further depression 32 is substantially rectangular in shape.

A tab 37 as shown in FIG. 4 extends from an end face of the small rectangular section of 34 and substantially parallel with it. The function of the tab 37 will be described later.

The housing body 24 further defines two attachment posts 38 which project from the rear wall of the first depression 30 such that they are level with the further depression 32. The attachment posts 38 are threaded internally.

When installed (as shown in FIG. 4), the flange portion 28 abuts the surface of the door 12 such that it is sealed against water ingress, optionally utilising a seal 29. Attachment bracket 26 is mounted on the inside of the door 12 so as to abut the inner surface of the door 12 and the attachment posts 38. Bolts 40 can then be threaded through washers 42 and through orifices (not shown) in attachment bracket 26 to be threadably engaged with the interior threads of the attachment posts 38 such that the paddle latch 10 is held in position.

The paddle 16 is constructed from a moulded plastic or stamped metal material and comprises handle portion 44 and hub portion 46. The handle portion 44 is substantially wider than the hub portion 46 and when in the closed position sits within the large rectangular section 36 of first depression 30 within the housing 18. The handle portion 44 is shorter than the large rectangular section of first depression 30 and consequently defines a finger hole 48 into which the operator's fingers may be inserted.

Figure 2:
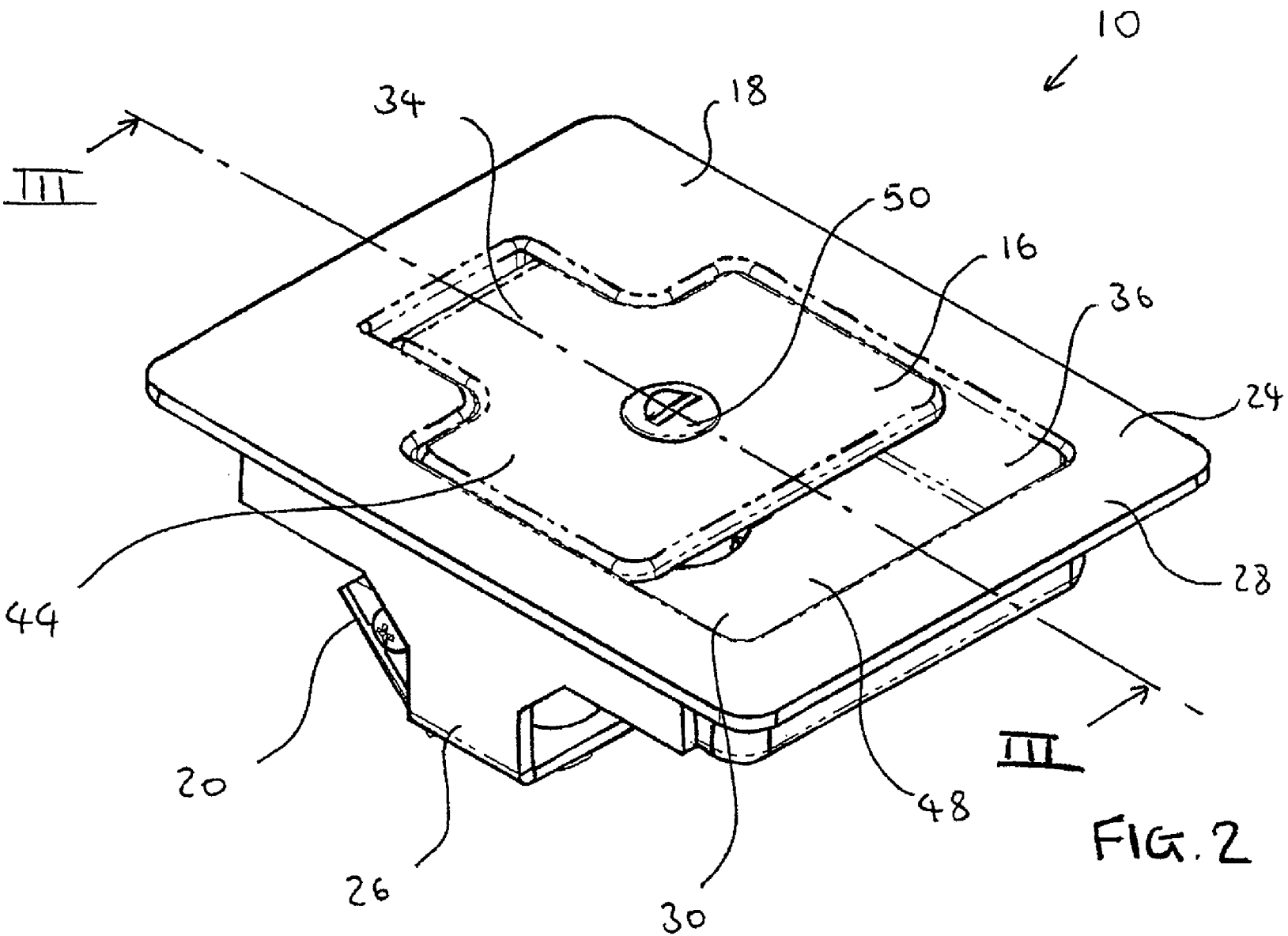
FIG. 2 is a perspective view of a paddle latch in accordance with the present invention.

The hub portion 46 sits within the small rectangular section 44 of the first depression 30. When the paddle 16 is in a closed position (as shown in FIG. 2) the surfaces of handle portion 44 and hub portion 46 are flush with the flange portion 28 of the housing 18.

The handle portion 44 optionally contains a lock 50 extending therethrough and into the housing 18 through the first depression 30 into the further depression 32. The lock 50 comprises a locking member 52 which may be rotated about the lock axis (denoted by broken line A in FIG. 3) following insertion of a key (not shown) such that the locking member 52 engages a feature of the further depression 32 such that the paddle 16 cannot be moved. This prevents the paddle latch 10 from being actuated and hence prevents the door from being opened.

The hub portion 46 extends into the first depression 30 of the housing 18 and defines a circular passageway 54 therethrough. The paddle 16 is positioned in the housing 18 such that it is able to rotate about the axis of the circular passageway 54.

A drive shaft 22 is depicted in FIG. 3*a* and comprises central a cylindrical section 56, a first end section 58 and a second end section 60, the end sections 58, 60 being semicircular in cross section. The end sections 58 and 60 may be formed by, for example, a machining operation on circular bar stock. The drive shaft 22 further comprises a threaded hole 62 extending at least part way through the central cylindrical section 56. The drive shaft 22 receives a grub screw 64 defining a complementary thread to that of the threaded hole 62. The cylindrical section has a diameter to be a snug fit in passageway 54 and has a length sufficient to extend into the opposite walls 39, 41 of the small rectangular section 34 of the housing 18. Furthermore, the cylindrical section comprises a first o-ring groove 59 and a second o-ring groove 61, into which drive shaft o-rings 63 fit (as shown in FIG. 4). The drive shaft o-rings 63 form a water and/or noise resistant seal between the interior and the exterior of the container.

The latch member 20 comprises a first latch arm 66, a second latch arm 68, a latch head 70, a latch spring 72, a return spring 73 and screws 74.

The first latch arm 66 and the second latch arm 68 are constructed from sheet metal material and each comprise a head portion 76, a centre portion 78 (substantially perpendicular to the head portion 76) and a base portion 80 (parallel to the head portion 76), such that the head portion 76 and the base portion 80 are offset by the length of the centre portion 78 as shown in FIG. 4. The latch head 70 is configured to sit between the head portions 76 of the latch arms 66, 68. It comprises a moulded metal or plastic body defining four threaded holes 82, which correspond to holes through the head portions 76 of the latch arms 66, 68. The screws 74 are inserted through the holes in the latch arms 66, 68 and engaged with the threaded holes 82 of the latch head 70 as shown in FIG. 4. In other embodiments the latch head may be adapted to suit various configurations of door and striker.

The base portions 80 of the latch arms 66, 68 each comprise an orifice 84 defining a circle sector with an angle greater than 180° as depicted in FIG. 4*a*. It should be noted that the shape of this orifice may vary greatly within the scope of the invention, and is generally dependent on the cross-sectional shape of the ends 58 and 60 of the drive shaft 22, as will be described later.

In order to assemble the paddle latch 10, the paddle 16 is inserted into the first depression 30 of the housing 18 as shown in FIG. 2. The circular passageway 54 lines up with the circular orifices 35 in the walls of the small rectangular section 34 in the housing 18. The axis on which these orifices lie is shown at R in FIG. 4.

Orifices 84 of the base portion 80 of the latch arms 66, 68 also line up with axis R, such that a passageway is defined through the latch arms 66, 68, the small rectangular section 34, and the circular passageway 54 which receives the drive shaft 22 as shown in FIG. 4. In this embodiment the drive shaft comprises seals (not shown) such as o-rings where it engages the housing in order to prevent the passage of liquid through the orifices 35. In other embodiments for applications with less stringent sealing requirements, the seals may be omitted.

The latch member 20 is positioned substantially perpendicular to the closure 12 as shown in FIG. 3 with the base portion 80 of the first latch arm 66 abutting the tab 37 of the housing 18 as shown in FIG. 4, such that it is able to rotate about the drive shaft 22 only in a clockwise direction from the state shown in FIG. 3.

Figure 7:
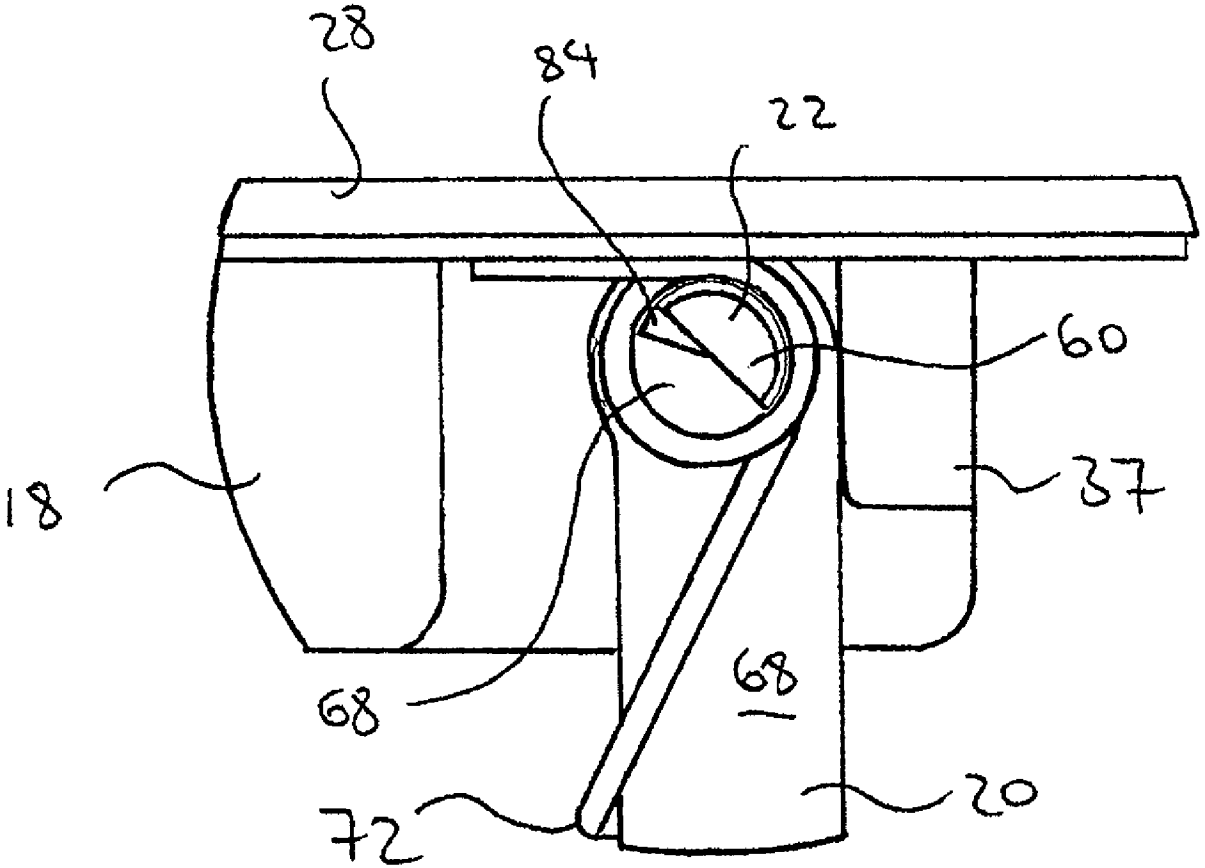
FIG. 7 is a side view of a part of the latch of FIG. 2.

The latch spring 72 is threaded onto the drive shaft 22 such that it engages the second latch arm 68 and the flange portion 28 of the housing 18 as shown in FIG. 7. The latch spring 72 therefore resiliently biases the latch member 20 in an anticlockwise direction when viewed in FIG. 7 (or alternatively a clockwise direction when viewed in FIG. 3) against the tab 37.

The return spring 73 is threaded onto the drive shaft 22 such that it engages the drive shaft 22 and the flange portion 28 of the housing 18. In this manner the return spring resiliently biases the drive shaft 22 (and therefore paddle 16) to its retracted position. The spring therefore need only be sufficiently strong to bias the paddle flush with the housing.

It should be noted that both springs 72, 73 are located on the interior of the paddle latch 10, and are therefore advantageously well protected from water damage which may impair their function.

Furthermore, the drive shaft 22 is rotationally positioned within the orifices 84 of the latch arms 66, 68 such that the flat end sections 58, 60 abut the corresponding surfaces of the orifices 84, of the latch arms 66, 68 so as to rotate the latch arms 66, 68 when a torque is applied to the drive shaft 22. As can be seen in FIG. 7, rotation of the latch member 20 in a clockwise direction through its normal range of motion, would not cause a corresponding rotation of the drive shaft 22 due to the shape of the orifice 84.

The paddle latch 10 is shown in FIG. 3 in a latched position. The door 12 is unable to open due to the interaction of the latch member 20 and the striker 15. Rotation of the paddle 16 by an operator's fingers inserted into finger hole 48 causes rotation of the drive shaft 22 via the engagement of the grub screw 64 with the drive shaft 22. This rotation causes the abutting surfaces of the drive shaft 22 and the latch member 20 to cause the latch member 20 to rotate as shown in FIGS. 8*a* to 8*b*.

Figure 8A:
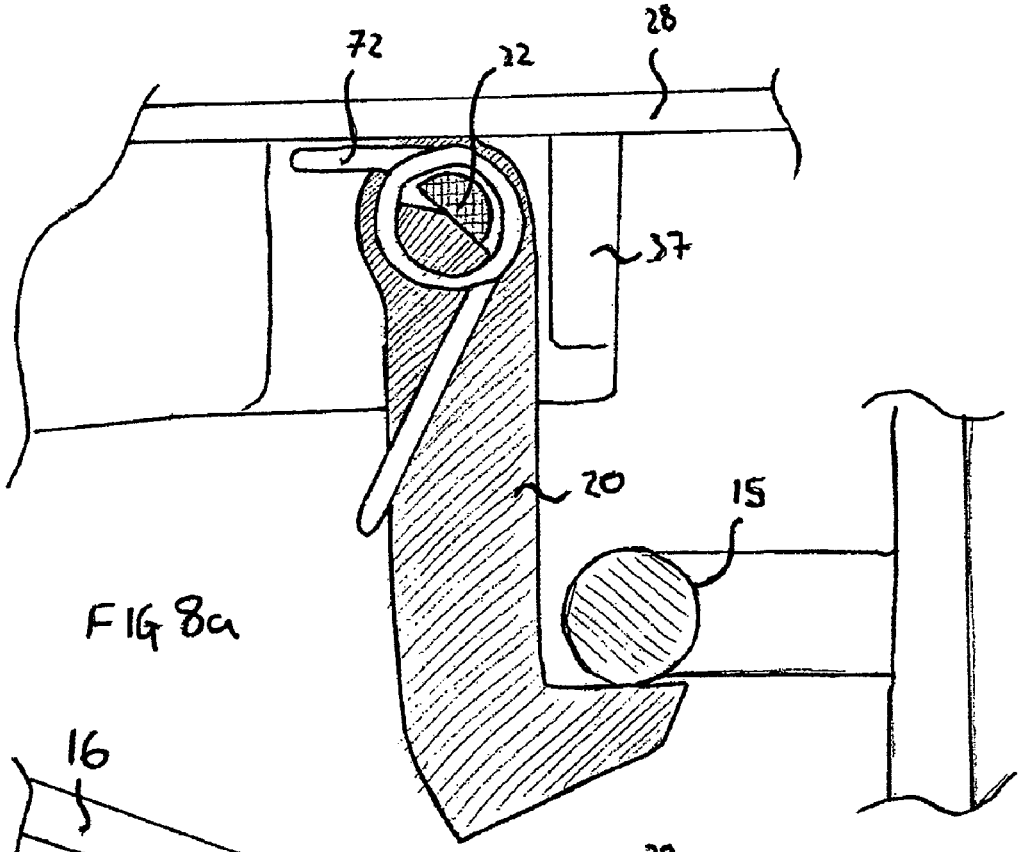
FIG. 8*a* is a similar view to FIG. 7 showing the latch of FIG. 2 interacting with a striker in a latched position.
Figure 8B:
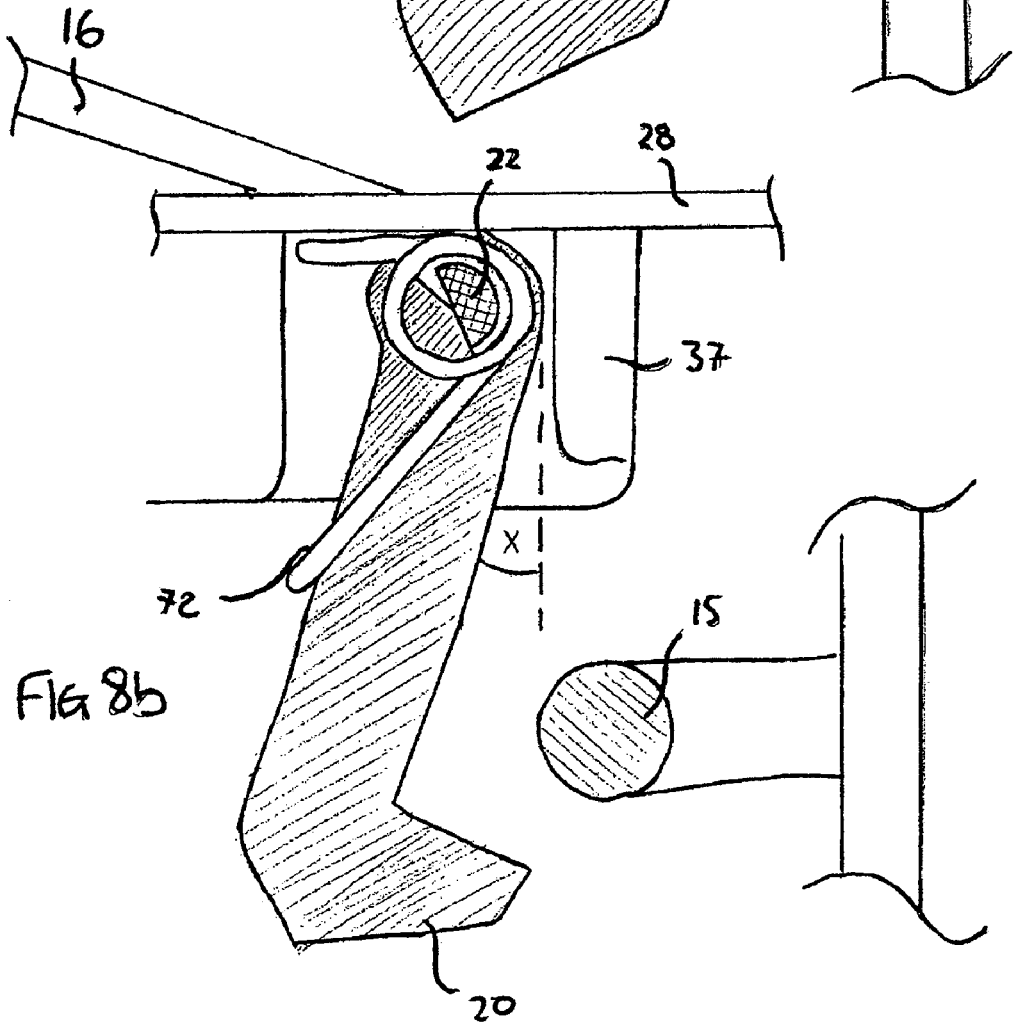
FIG. 8*b* is a similar view to FIG. 8*a* showing the latch of FIG. 2 in an unlatched position as actuated by a user.

FIG. 8*a* shows a view similar to that of FIG. 7 with the shaft 22 cross-hatched and the latch member 20 hatched for clarity. The latch spring 72 abuts the flange portion 28 and the latch member 20 such that it is biased in an anticlockwise direction against the tab 37. FIG. 8*b* shows the condition whereby the paddle 16 has been used to rotate the drive shaft 22 by angle X. This rotation acts against the bias of the latch spring 72 and rotates the latch arm 20 by angle X moving the latch member 20 out of alignment with striker 15 such that the door may be opened (from the position shown in FIG. 8*b*).

The torsional restoring force of the latch spring 72 acts to bias the latch member 20 back to the position shown in FIG. 8*a*. The torsional restoring force of the return spring 73 acts to bias the paddle back to its original position in order to avoid accidental damage as a result of its exposure.

The container 14 comprises a striker 15 (as shown in FIG. 3) with which the panel latch 10 interacts in order to secure the door 12 in a closed position. The striker 15 may take many forms but is generally a metal member or bar attached to the container 14.

Figure 9A:
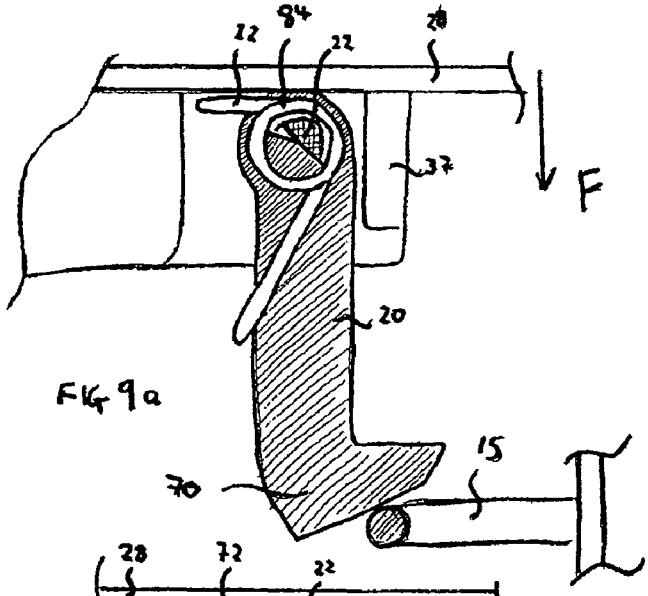
FIG. 9*a* is a similar view to FIG. 7 showing the latch of FIG. 2 interacting with a striker with the closure in an open position.
Figure 9B:
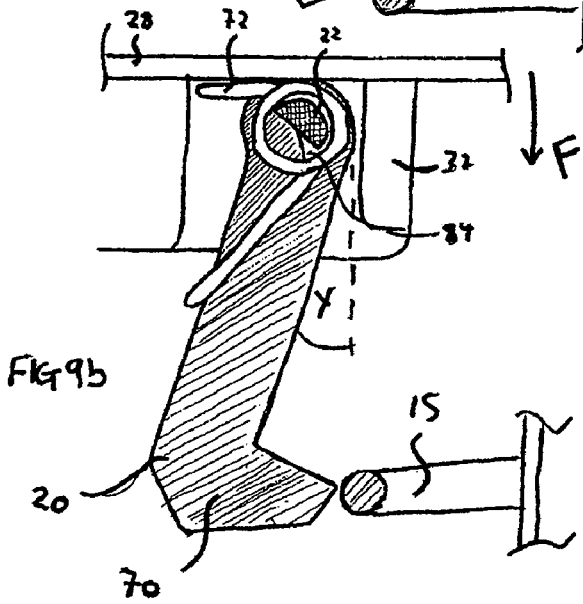
FIG. 9*b* is a similar view to FIG. 9*a* showing the latch interacting with a striker upon movement of the closure from an open to a closed position.
Figure 9C:
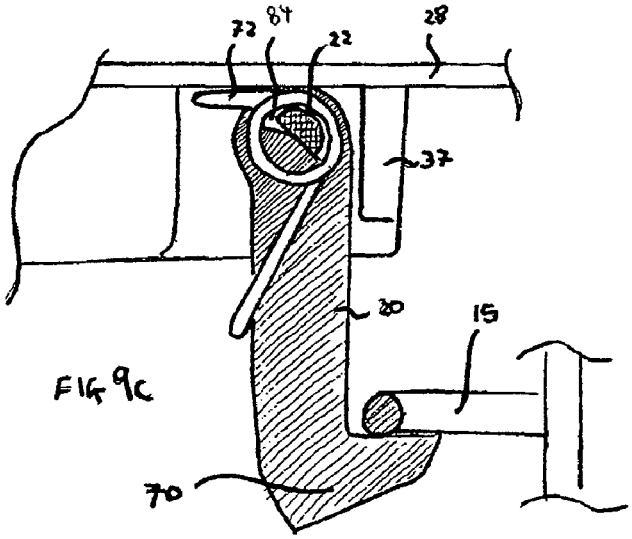
FIG. 9*c* is a similar view to FIG. 9*b* showing the latch of FIG. 2 interacting with a striker when the closure is in a closed position.

FIGS. 9*a* to 9*c* show a slamming event whereby an open door is required to be closed by pushing on the paddle 16. In this situation it is undesirable for the paddle 16 to move for the reasons discussed above.

In FIG. 9*a*, a force is applied to the door 12 or paddle latch 10 (usually by the paddle 16) in the direction shown by arrow F. In order for the latch member 20 to pass the striker 15, the inclined surface on the latch head 70 slides along the striker 15, causing the latch member 20 to rotate by angle Y as shown in FIG. 9*b*. As the orifice 84 defines a sector of a circle substantially larger than the semi-circular profile of the corresponding flat end section of the shaft 22, the latch member 20 can rotate freely without engaging the drive shaft 22 against the resilient bias of the latch spring 72. When the door has closed far enough for the latch head 70 to pass the striker 15, the resilient bias of the latch spring 72 causes the latch member 20 to return to its position abutting the tab 37 as shown in FIG. 90. This entire sequence occurs without movement of the paddle 16.

It should be understood that the angle of the sector defined by the orifice 84 should be greater than the maximum desired angle of rotation, Y, experienced when the door is closed in the manner described above. If this is not the case, then the latch member 20 will engage the drive shaft 22 actuating the paddle 16, which is undesirable.

If, when in a closed position as shown in FIG. 3, it is desired that the paddle latch 10 should be locked such that the door 12 cannot be opened, then the lock 50 may be engaged in a blocking position such that the paddle 16 cannot move and therefore it would not be possible to actuate the latch member 20 by using the paddle 16. However, it should also be noted that if the lock is engaged whilst the door 12 is open, then it is entirely possible to slam the door in the manner described above, as the latch member 20 can rotate without engaging the drive shaft 22. Therefore, it is not possible to damage any of the components of the paddle latch 10 by slamming the door 12 when the lock 50 is engaged.

It should be understood that the interaction between the drive shaft 22 and the latch member 20 may be defined by a wide range of geometries. Any interaction between the drive shaft and the latch member that results in torque being transferred with relative rotation of the two components in a first direction (e.g. if the drive shaft 22 is rotated clockwise from FIG. 8*a* to FIG. 8*b*) but not in a second direction (e.g. if the latch member is rotated in a clockwise sense from FIG. 9*a* to FIG. 9*b*) is within the scope of the invention. Optionally, at the point at which the drive shaft and the latch member interact, the drive shaft cross-section may define a circle sector with a first included angle, and the orifice in the latch member a circle sector with a second included angle. As long as the second included angle is Y° above the first included angle, where Y° is the maximum desired angle of rotation of the latch member, then the latch will operate. In the embodiment described here, the first included angle is 180° (a semicircle) and the second included angle is (180+Y)°. It should be noted that the first included angle may vary greatly within the scope of the invention. Examples of alternative geometries of drive shafts and latch members are described below.

Figure 10:
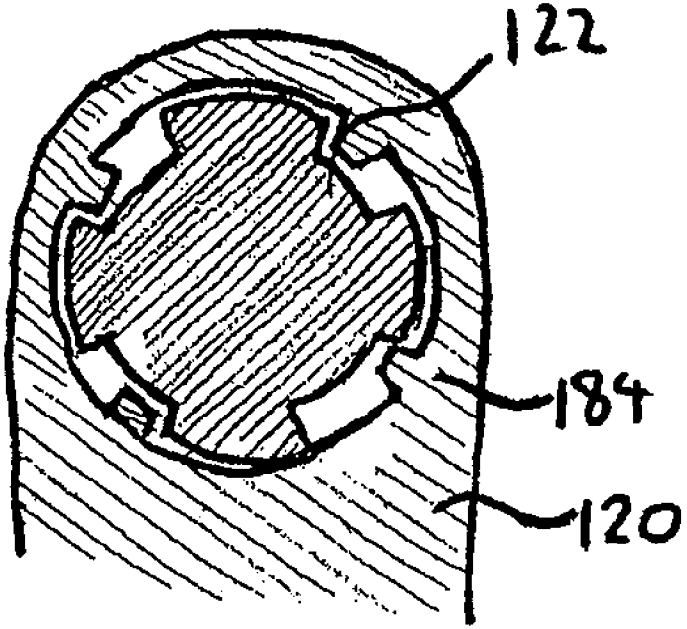
FIG. 10 is a section view of a drive shaft interacting with a latch arm according to a further embodiment of the latch of FIG. 2.

FIG. 10 shows an alternative embodiment of the device whereby drive shaft 122 comprises a spline-type cross section instead of a flat end section. The corresponding orifice 184 on latch member 120 defines a spline with wider grooves such that rotation of the drive shaft 122 in a clockwise fashion will engage the latch member 120 but corresponding motion of the latch member 120 will not cause rotation of the drive shaft 122.

Figure 11:
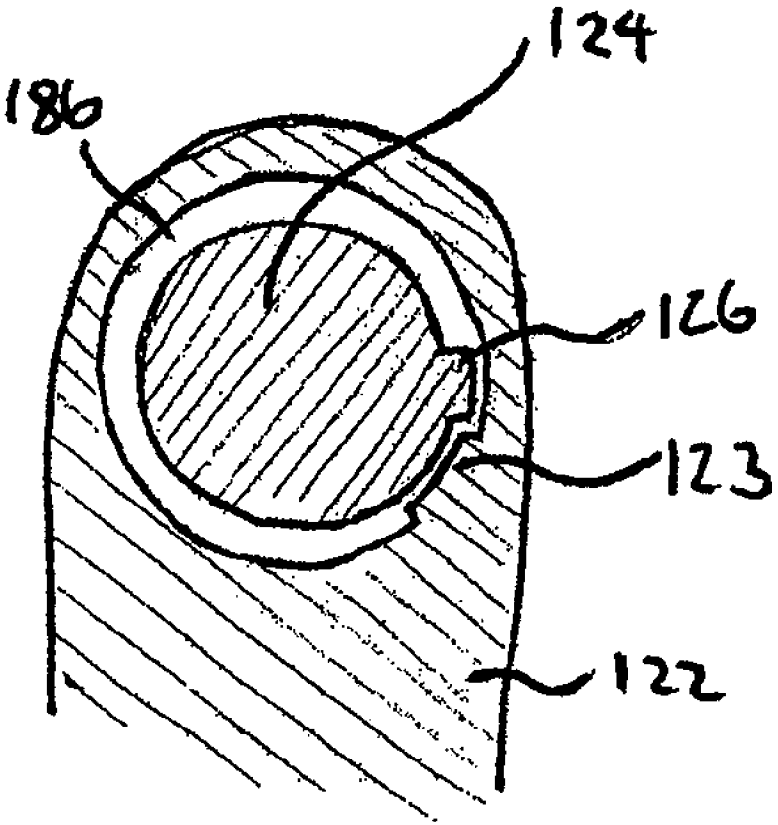
FIG. 11 is a section view of a drive shaft interacting with a latch arm in accordance with the still further embodiment of the latch with FIG. 2.

FIG. 11 shows another embodiment of the invention whereby the shaft 124 comprises a protrusion 126 and the latch member 122 comprises a corresponding protrusion 123 in orifice 186, such that clockwise rotation of the shaft 124 causes corresponding rotation of the latch member 122 but clockwise rotation of the latch member 122 will not cause rotation of the drive shaft 124. Alternatively, the protrusion 126 of the drive shaft 124 could be provided via a key and keyway assembly.

It will be appreciated that by using the shaft to transfer torque from the paddle to the latch member means that only the shaft needs to extend from the exterior of the housing through to the interior. Inherently, it is far easier to seal this type of opening through the housing than the openings of known paddle latches, resulting in a latch that is cost-effective to manufacture, whilst achieving the desired sealing properties.

Numerous changes may be made within the scope of the present invention. Two examples of alternative drive shaft/latch member interfaces have been given in FIGS. 10 and 11. The intention that any mechanical interface may be used as long as it provides torque transmission in a first direction but not in a second. Consequently, a large range of profiles of the drive shaft and corresponding orifice may be selected.

The lock 50 does not have to contact the housing to prohibit the movement of the paddle 16, rather it may pass through the housing 18 and directly engage the latch member 20 when in a locked position.

The latch member 20 need not be in a vertical position when latched, the position may vary depending on the relative position of the paddle latch 10 and the striker 15.

The biasing method used may vary from the torsional latch spring 72. For example, a linear compression spring may be used between the latch member 20 and a corresponding surface of the housing 18.

Different methods may be used to provide the mechanical connection between the paddle 16 and the drive shaft 22. The grub screw 64 may be replaced with an interference fit between the drive shaft 22 and the paddle 16. For example, the drive shaft 22 may be profiled to define a flat portion (such as seen in FIG. 3*a* at 58) all the way along, and the paddle 16 may define a corresponding orifice such that rotation of the drive shaft 22 within paddle 16 is not possible.

This concept extends to the further examples shown in FIGS. 10 and 11 whereby the features of the drive shaft may extend along its length and the passageway 54 of the paddle 16 and may be adapted to engage them.

The application of the paddle latch 10 is not limited to doors but may be any type of closure. Correspondingly, a resilient biasing means (in this case latch spring 72) may not be present at all and the paddle latch 10 may be mounted such that the latch member 20 is restored to its latch position by action of gravity, or other suitable means.

The lost motion created between the end sections 58, 60 of the drive shaft 22 and the orifices 84 of the latch arm 20 may alternatively exist between the centre portion 56 of the drive shaft 22 and an orifice in the hub portion 46 of the paddle 16. In this instance, the drive shaft 22 and the latch member 20 would be fixably attached so as to rotate together.

In order to facilitate assembly, the drive shaft 22 may comprise two separate components for insertion at either side of the latch. In this way the drive shaft 22 would not have to pass all the way through the hub portion 46 of the paddle 16.

The drive shaft o-rings 63 are provided to seal the circular orifices 35. Alternatively, design tolerances and materials selection may be made such that sufficient relative motion and sealing is created without further sealing means.

The output from the shaft may be adapted to drive an alternative form of latch member, such as a sliding latch bolt. Also, either or both of the latch spring or the return spring may be replaced with resilient means integrated to the components which they bias. For example small, leaf-spring type structures could be machined in the orifices of the latch arm to interact with the drive shaft in this manner.

Locks are commonly employed in paddle latches for security reasons, but in certain embodiments may be omitted if so desired.

The invention claimed is:

1. A paddle latch comprising:

a housing defining a first side and a second side;

a drive shaft extending through the housing defining a first shaft portion on the first side and a second shaft portion on the second side;

a paddle for actuation by a latch user on the first side; and a releasable latch member comprising a latch arm and a latch head, the latch head provided for co-operation with an associated striker to latch the paddle latch on the second side;

wherein the paddle is connected to the first shaft portion and the latch arm of the latch member includes an orifice that receives the second shaft portion such that torque may be transferred from the paddle to the latch member to release the latch head from the striker in use, in which there is a lost motion feature between the paddle and the latch member such that torque is directly transferred between the drive shaft and the latch member in a first relative rotational direction, but not in a second relative rotational direction and in which the drive shaft comprises a flat section that abuts a corresponding surface of the latch member so as to rotate the latch member when torque is applied to the paddle, and wherein rotation of the latch member through its normal range of motion does not cause a corresponding rotation of the drive shaft and the paddle.

2. A paddle latch according to claim 1 in which the lost motion feature is configured to permit a predetermined amount of movement of the latch member with no corresponding movement of the paddle.

3. A paddle latch according to claim 1 in which the lost motion feature is between the drive shaft and the latch member.

4. A paddle latch according to claim 1 in which the housing is configured to support the drive shaft.

5. A paddle latch according to claim 1 wherein the housing comprises two substantially opposed walls and the drive shaft passes through the two substantially opposed walls.

6. A paddle latch according to claim 4 in which the substantially opposed walls are provided with bores dimensioned to act as bearings for the shaft.

7. A paddle latch according to claim 1 further comprising a seal between the shaft and the housing.

8. A paddle latch according to claim 1 further comprising a biasing device to bias the latch member towards a latched position.

9. A paddle latch according to claim 1 further comprising a biasing device to bias the paddle towards a retracted position.

10. A paddle latch according to either claim 8 in which the biasing means is located on the second side.

11. A paddle latch according to claim 1 further comprising a lock configured to prevent the paddle latch from being actuated from a latched position to an unlatched position.

12. A closure including a paddle latch, the paddle latch comprising:

a housing defining a first side and a second side;

a drive shaft extending through the housing defining a first shaft portion on the first side and a second shaft portion on the second side;

a paddle for actuation by a latch user on the first side; and a releasable latch member comprising a latch arm and a latch head, the latch head provided for co-operation with an associated striker to latch the paddle latch on the second side;

wherein the paddle is connected to the first shaft portion and the latch arm of the latch member includes an orifice that receives the second shaft portion such that torque may be transferred from the paddle to the latch member to release the latch head from the striker in use, in which there is a lost motion feature between the paddle and the latch member such that torque is directly transferred between the drive shaft and the latch member in a first relative rotational direction, but not in a second relative rotational direction and in which the second shaft portion of the drive shaft comprises a flat section that abuts a corresponding surface of the latch member so as to rotate the latch member when torque is applied to the drive shaft, and wherein rotation of the latch member through its normal range of motion does not cause a corresponding rotation of the drive shaft.

13. A paddle latch for a door of a container comprising:

a housing including a front surface and an aperture that is defined in the front surface;

a paddle positioned in the aperture, the paddle including a handle that is moveable between (i) a closed position in which the handle extends parallel to the front surface of the housing, and (ii) an open position in which the handle extends outwardly from the aperture;

a drive shaft secured to the paddle, the drive shaft including an end section having a substantially planar surface;

a latch member comprising a latch arm coupled to the drive shaft at a first end and a latch head extending from a second end of the latch arm, the latch arm being pivotable between (i) a first position in which an engagement surface of the latch head is configured to engage a striker of the container to secure the door to the container, and (ii) a second position in which the engagement surface of the latch head is configured to be spaced apart from the striker, wherein (i) the latch arm includes a first inner wall and a second inner wall, the first inner wall and the second inner wall defining an orifice that receives the end section of the drive shaft, (ii) the first inner wall has a first substantially planar surface configured to engage the substantially planar surface of the drive shaft when the handle is moved from the closed position to the open position, (iii) the second inner wall has a second substantially planar surface configured to engage the substantially planar surface of the drive shaft when the latch member is moved from the first position to the second position and when the handle is maintained in the closed position, and (iv) an obtuse angle is defined between the first substantially planar surface of the first inner wall and the second substantially planar surface of the second inner wall.

* * * * *

UNITED STATES PATENT AND TRADEMARK OFFICE

CERTIFICATE OF CORRECTION

PATENT NO. : 8,136,850 B2
APPLICATION NO. : 11/693428
DATED : March 20, 2012
INVENTOR(S) : Martin Wollacott et al.

It is certified that error appears in the above-identified patent and that said Letters Patent is hereby corrected as shown below:

On the Title page, at Assignee (73), change "Western Body Hardware Limited (GB)" to --Weston Body Hardware Limited (GB)--.

Signed and Sealed this
Tenth Day of July, 2012

David J. Kappos

David J. Kappos
*Director of the United States Patent and Trademark Office*